United States Patent [19]

Rose

[11] 4,139,796

[45] Feb. 13, 1979

[54] PHOTOCONDUCTOR FOR IMAGING DEVICES

[75] Inventor: Albert Rose, Princeton, N.J.

[73] Assignee: RCA Corporation, New York, N.Y.

[21] Appl. No.: 661,614

[22] Filed: Feb. 26, 1976

Related U.S. Application Data

[63] Continuation of Ser. No. 513,392, Oct. 9, 1974, abandoned, which is a continuation-in-part of Ser. No. 423,454, Dec. 10, 1973.

[51] Int. Cl.[2] ..... H01J 29/45; H01J 31/38

[52] U.S. Cl. ..... 313/385; 313/386

[58] Field of Search ..... 313/384, 386

[56] References Cited

U.S. PATENT DOCUMENTS

| | | | |
|---|---|---|---|
| 2,881,340 | 4/1959 | Rose | 313/384 |
| 3,136,909 | 6/1964 | Cope | 313/366 |
| 3,258,434 | 6/1966 | Mackenzie et al. | 313/376 X |
| 3,344,300 | 9/1967 | Lehrer et al. | 313/463 |
| 3,398,021 | 8/1968 | Lehrer et al. | 313/385 X |
| 3,419,746 | 12/1968 | Crowell et al. | 313/367 |
| 3,783,324 | 1/1974 | Wronski et al. | 313/366 |
| 3,805,128 | 4/1974 | Scholl et al. | 357/31 |

FOREIGN PATENT DOCUMENTS

| | | | |
|---|---|---|---|
| 2097370 | 3/1972 | France | 313/366 |
| 1344350 | 1/1974 | United Kingdom | 313/366 |

OTHER PUBLICATIONS

Tabak, Physical Review B; vol. 2; Number 6, Sep. 15, 1970; "Temperature Dependence of Hole Transport in Vitreous Selenium;" pp. 2104–2108.

*Primary Examiner*—Robert Segal

*Attorney, Agent, or Firm*—E. M. Whitacre; G. H. Bruestle; R. M. Rodrick

[57] ABSTRACT

A substantially flat body of a photoconductive semiconductor material is coated on one surface with an electrically conductive layer. A layer of a solid insulator material is on another surface of the semiconductor material. The insulator material is of the type having mobile deep lying carriers and forms a blocking junction with the semiconductor material. The insulator material may be an electronically conductive glass, an ionically conductive glass, or a cermet composition. The photoconductor can be used as a target for a camera tube, or as an electrophotographic plate.

9 Claims, 3 Drawing Figures

PHOTOCONDUCTOR FOR IMAGING DEVICES

This application is a continuation of U.S. application Ser. No. 513,392, filed on Oct. 9, 1974, now abandoned which was a continuation-in-part of U.S. application Ser. No. 423,454, filed on Dec. 10, 1973.

BACKGROUND OF THE INVENTION

The present invention relates to a photoconductive imaging device, such as a vidicon camera tube or electrophotographic device, and particularly to a photoconductive imaging device having a solid insulator material on a surface of a body of semiconductor material and forming a blocking contact with the semiconductor material.

The target for a vidicon type camera tube, in general, comprises a photoconductor body having one surface which is exposed to the light pattern being viewed and an opposed surface which is scanned by an electron beam. A major problem in the design of such targets, particularly where the photoconductor is a semiconductor material, is to insure that the scanning electron beam makes blocking contact to the photoconductor, i.e., the electrons do not enter the interior volume of the photoconductor. At the same time, it is necessary that the holes generated in the photoconductor by the viewed light pattern can leave the photoconductor on the scanned side in order to be combined with and be neutralized by the electrons from the scanning beam.

Ordinarily, such blocking contact has been provided either by a high work function material on the scanned surface of the photoconductor which forms a Schottky surface barrier junction, or by a P type conductivity region along the scanned surface of an N type conductivity photoconductor to form a blocking PN junction at the scanned surface. However, in both of these techniques, the surface of the photoconductor becomes laterally too conducting to preserve the charge pattern and must be broken up or structured in some way into an array of individual blocking contacts so as to preserve surface insulation. The need to have a structured surface has the disadvantage that the process required to make such a surface is relatively expensive and defect prone. Further, camera tubes which have employed insulator type layers in non-structured camera tube targets, on semiconductor photoconductive bodies, such as CdSe, have required relatively expensive and complicated processing to avoid, to some extent, undesirable levels of dark current, and/or other important characteristics.

The photoconductor plate of an electrophotographic device is similar to the target of a camera tube and has similar problems.

SUMMARY OF THE INVENTION

A photoconductive imaging device includes a body of semiconductor material having opposed surfaces and a layer of a solid insulator material on a surface of the semiconductor body. The insulator material is of the type having mobile deep lying carriers and forms a blocking contact with the semiconductor body.

DETAILED DESCRIPTION

Figure 1:
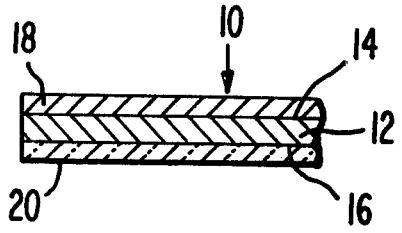
FIG. 1 is a sectional view of a portion of the photoconductor of the present invention.

Referring initially to FIG. 1, the photoconductor of the present invention is generally designated as 10. The photoconductor 10 comprises a substantially flat light receiving body 12 of a photoconductive semiconductor material, such as silicon, gallium arsenide, gallium phosphide, cadmium selenide, cadmium telluride, etc., having opposed surfaces 14 and 16. The particular semiconductor material used depends on the wavelength of the light to be viewed by the photoconductor. The semiconductor body 12 preferably has a carrier density no greater than about $10^{16}$ electrons/cc. and is of a thickness of between 1 and 20 microns. The thickness and carrier density of the semiconductor body 12 should be such that the semiconductor body will be substantially fully depleted of charge carriers at the voltage placed across the semiconductor body in the use of the imaging device in which the photoconductor 10 is employed. On the surface 14 of the semiconductor body 12 is a layer 18 of a transparent conductive material, such as a metal or tin oxide.

On the surface 16 of the semiconductor body 12 is a layer 20 of between approximately 100Å and 1000Å thick of a solid insulator material. The material of layer 20 has a high density of (i.e., from about $10^{14}$ to about $10^{19}$) "deep lying" carriers/cc., located substantially at the Fermi level, or "further removed" from the appropriate conducting band (i.e., the "valence" or "conduction" band) as hereinafter clarified. The mobility of these carriers is low, from about $10^{-6}$ to about $10^{-12}$ $cm^2$/volt second, so that the material is in the class of insulators or near insulators. The material of layer 20 must be of a resistivity greater than about $10^{12}$ ohms/square, and less than about $10^{18}$ ohms/square. In contrast, the usual insulators may be characterized as having mobile carrier densities of less than $10^8$ per cc. with the mobilities of those carriers being typically between 1–10 $cm^2$/volt second. The material of layer 20 must also be capable of forming a blocking contact with the semiconductor body 12.

Layer 20 preferably consists of a material selected from a granular metal-insulator system, i.e., a mixture, or combination, of an insulator material with substantially uniformly dispersed granular metal particles. The density of granular metal particles within a particular insulator material may be selected in accordance with the desired: carrier density, mobility of the carriers, and surface resistivity. The well known cermets, which are small particles of conductive metal dispersed throughout a matrix of a glass, or other ceramic-like material, are materials of a granular metal-insulator system which are particularly preferred for the composition of the layer 20.

The cermets which are suitable include those which are formed by co-depositing, either by sputtering or vacuum evaporation, a conductive metal such as gold, silver, copper, tungsten, aluminum, etc., and an insulator, such as silicon dioxide and aluminum oxide; or of the type wherein a mixture of the metal particles and a glass frit, or other sealing glass material, is applied and fired onto the surface of the semiconductor body 12. In this later structure, each of the metal particles acts as a single charge carrier. Generally, conductive particles, such as metal particles of a cermet, may be mixed in suitable proportions with a sealing glass to achieve, within a fired structure, a desired carrier density and resistivity.

Other solid insulator type materials having the desired resistivity, carrier concentration, and ability to form a blocking contact with the semiconductor body 12 may be utilized to advantage for the material of layer 20. For example, the material composition of layer 20 may comprise an electronically conductive glass, such as $V_2O_5$-$P_2O_5$ or $V_2O_5$-$K_2PO_3$, or an equivalent vanadium oxide-phosphate glass. Such materials have deep lying carriers at or near (i.e., "substantially at") the Fermi level and have an ability to form a blocking contact with the semiconductor body 12. Alternatively, ionically conductive solids having deep lying carriers at or near the valence band may be employed to advantage since they also possess, generally, an ability to form a blocking contact with an n type conductivity semiconductor material. Conversely, ionically conductive solids, having deep lying carriers at or near the conduction band, may also similarly be employed to advantage to form a blocking contact with p-type conductivity semiconductor material.

Figure 2:
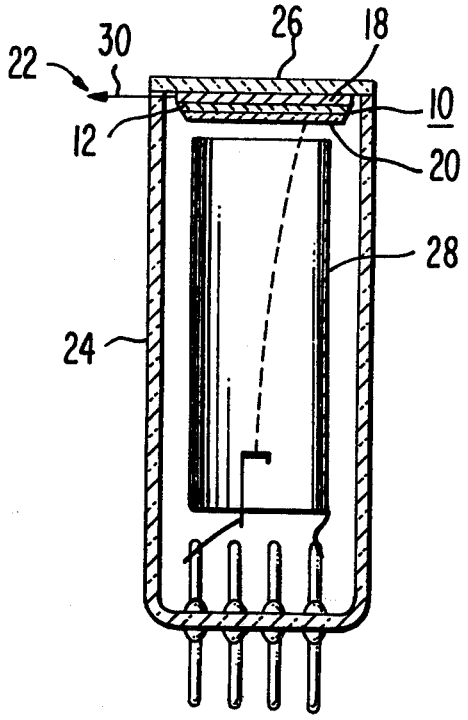
FIG. 2 is a sectional view of a vidicon type camera tube which includes the photoconductor of the present invention as a target.

Referring to FIG. 2, a vidicon type camera tube, which incorporates the photoconductor 10 of the present invention, is generally designated as 22. The camera tube 22 is of conventional construction and includes an elongated envelope 24 having a transparent faceplate 26 at one end thereof. The semiconductor body 12 of the photoconductor 10 in FIG. 2 preferably is composed of an n-type conductivity semiconductor material. An electron beam forming and scanning means 28 is within the envelope 24. The electron beam forming and scanning means 28 may be of any well known construction. The photoconductor 10 of the present invention is within the envelope 24 and is attached to the inside surface of the faceplate 26 the same as the target of a camera tube. Scanning of the electron beam may also be achieved by magnetic coils (not shown) situated outside the envelope 24. As shown in FIG. 2, the photoconductor 10 is mounted in the envelope with the conductive layer 18 contacting the inside surface of the faceplate 26 and the insulator material layer 20 facing the electron beam forming and scanning means 28. The conductive layer 18 is of a light transparent, conductive material, such as tin oxide.

In the operation of the tube 22, the voltages applied to its various elements may be on the order of the preferred voltages for use in vidicon type tubes known to those skilled in the art. The scanning means 28, which may include an electron gun device with electrostatic deflection, scans the surface of the insulator material layer 20 of the photoconductor target 10 with an electron beam, the surface being exposed directly to the electron beam. The insulator material layer 20 "thermalizes" the beam electrons by capturing the electrons into the "deep lying" levels. For example, in the case of a cermet composition, or an electronically conductive glass, for the material of layer 20, the electrons are captured near the Fermi level as shown in the energy diagram of FIG. 3. If, on the other hand, the material of layer 20 is an ionically conductive glass having "deep lying" carriers near the valence band (assuming n-type conductivity for the semiconductor body 12), the electrons are captured in deep lying energy levels near the valence band. This "thermalizing" of electrons into "deep lying" carrier levels causes charged carriers to accumulate at the interface between the layer 20 and the semiconductor body 12 because of the previously described mobility of the deep lying mobile carriers of the material of layer 20 through that layer. The high resistivity of the insulator material of layer 20 limits lateral movement of the electrons along the interface thereby permitting an electrical charge pattern buildup along that interface surface.

Figure 3:
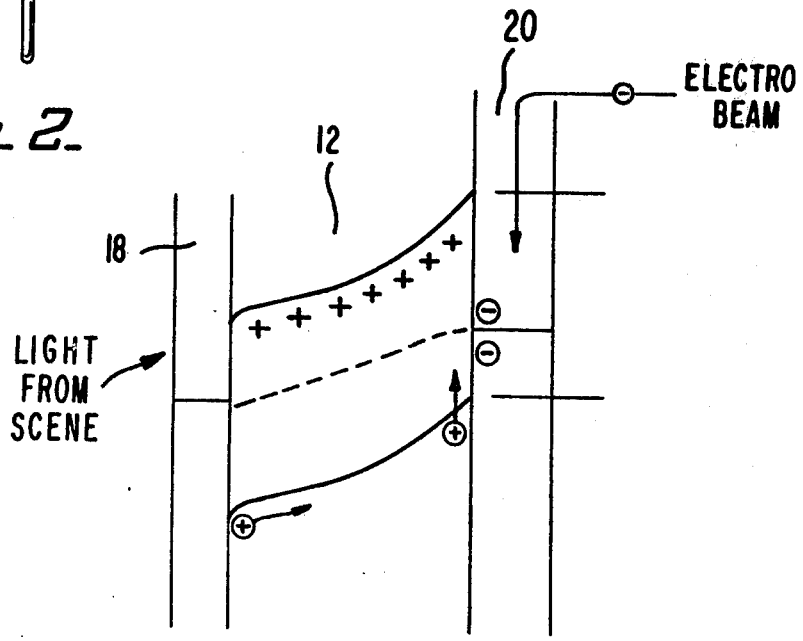
FIG. 3 is an energy diagram of the photoconductor of the present invention employing a cermet insulator layer.

The light image from the viewed scene passes through the faceplate 26 and the transparent conductive layer 18 and generates electron-hole carrier pairs in the semiconductor body 12 in accordance with the intensity pattern of the light from that viewed scene. As shown in the diagram of FIG. 3, the holes sweep across the semiconductor body 12 and recombine with the accumulated electrons at the interface of the semiconductor body 12 and the insulator material layer 20, thereby reducing the electrical charge along that surface in accordance with the light intensity pattern of the viewed scene. The photogenerated electrons are carried by the transparent conductive layer 18 to the output line 30 to a fixed voltage source. In this manner a residual charge pattern is formed, along a portion of the layer 20 abutting the body 12, at the interface between the semiconductor body 12 and the layer 20. Generally, the intensity of the charge pattern varies along the layer in accordance with the light intensity pattern of the viewed scene and comprises a charge image replica of that scene. A dark current is produced by the thermal emission of electrons from the conductive glassy material layer 20 into the semiconductor body 12.

Thus, in the photoconductor target of the present invention, the insulator material layer 20 serves to collect the electrons from the scanning beam and block the flow of the electrons from the scanning beam into the semiconductor body 12 (i.e., forms a "blocking contact") in the same manner as a metal film or PN junction. A residual charge pattern is formed along the interface between the layer 20 and the semiconductor body 12 by means of the photogenerated carriers which recombine with electrons accumulated at that interface. The high resistivity characteristics of the insulator material layer 20 minimizes lateral leakage of charge at the interface, thereby substantially maintaining the charge intensity pattern, and thereby avoiding any necessity for breaking up, or structuring, the layer 20 into an array of individual blocking contacts, as ordinarily required with imaging structures utilizing a metal film or a PN junction to form a blocking contact with a semiconductor photoconductor. For this reason, and also since the insulator layer 20 forms a blocking contact with the semiconductor body 12 which is analogous to a PN junction, loss of charge at the interface is substantially avoided during periods of time of less than about 1/10 of a second in the structure described.

The photoconductor 10 can also be used as the plate of an electrophotographic device. For such use, a charge or electrical potential, either negative or positive, is placed across the layer 20. This can be achieved by placing a metal electrode in contact with the surface of the layer 20 and by applying a bias between that electrode and the semiconductor body 12. The electrons, or holes (depending on the sign or polarity of the surface charge desired at the interface between the layer 20 and the body 12) entering the layer are trapped therein and accumulated at the interface between the layer 20 and the semiconductor body 12 because of the blocking junction at this interface.

The body 12 is then exposed to a light image from the scene being photographed, such as a printed page. The light image may pass through either the layer 20 (if transparent), or the transparent electrode contact (such as 16), and thereafter, enter the semiconductor body 12 to generate electron-hole carrier pairs in the semiconductor body. Photogenerated charged carriers travel to the interface between the semiconductor body 12 and the layer 20 to combine with the accumulated charged carriers thereat. If the layer 20 is charged negative, the photogenerated holes travel to the interface, and if the layer 20 is charged positive, the photogenerated electrons travel to the interface. This leaves a residual pattern of accumulated charge carriers along the conductive layer 20, which is substantially a charge replica of the image of the scene being photographed.

A source of ink particles is passed over the layer 20. The ink particles are attracted to the portions of the layer 20 which contain the charge carriers so as to provide an ink pattern on the layer. The ink pattern is then transferred to a permanent support, such as a sheet of paper, and is bonded thereto, such as by heating.

Thus, in an electrophotographic device, the layer 20 of the photoconductor of the present invention serves to collect the charge carriers therein and block the flow of the carriers into the semiconductor body 12. The carriers are patterned by the light from the scene being photographed. The high resistivity characteristics of the layer 20 prevents lateral leakage of the carriers so as to permit the achieving of an ink pattern which corresponds to the image of the viewed scene.

The terminology "deep lying" carriers as herein utilized, is intended to be descriptive of carriers having an energy level substantially at the Fermi level, or an energy level "further removed" than the Fermi level (i.e., "above" or "below" the Fermi level, in an energy band diagram) from the conducting band appropriate to the polarity (i.e., respectively, the valence band, for hole conduction; or the conduction band, for electron conduction) of the surface charge accumulated at the interface between the semiconductor body 12 and layer 20. For example, if holes are to be accumulated at that interface, and if an ionically conductive glass is employed for the layer 20, the "deep lying" carriers must be "above" the Fermi level, in an energy band diagram, further removed from the valence band which is the appropriate conducting band for holes. In order to provide a blocking contact with the semiconductor body 12, whereby charged carriers are prevented from being conducted through the photoconductor 10, the deep lying carriers of that material should be selected to be sufficiently far removed from the conducting band, which is appropriate to the polarity of the surface charge, to form the blocking contact desired.

The photoconductor 10, above described, may be distinguished from prior art semiconductor imaging structures employing insulator layers on a semiconductor body in numerous respects. In particular, since the structures herein described employs an insulator layer 20 having mobile deep lying carriers, as previously defined, the photoconductor 10 does not require the application of excessive voltages across the layer 20 in order to move the charge which is applied to the surface of that layer 20, through that layer, to the interface between the body 12 and the layer 20. In fact, a voltage of less than 1 volt, for an insulator layer thickness of 1000A is considered adequate to provide suitable imaging operation of the photoconductor 10 without affecting the dark current performance of the device. Accordingly, the material of layer 20 permits neutralization of surface charge by photogenerated carriers without significant voltages or fields being applied across that layer. In contrast, a higher voltage, exceeding 5 volts is required for a similar structure employing a conventional insulator layer without mobile deep lying carriers, and having a thickness of 1000Å. With such a prior art conventional imaging device, the high voltages and fields required to permit neutralization of surface charge by photogenerated carriers tends to destroy the ability of the devices to block surface charge from entering the appropriate conducting band of their semiconductor bodies, thereby increasing the dark current of the devices, and also gives rise to other deleterious effects such as, for example, an undesirable "after image" caused by the persistence of charge patterns resulting from prior images.

What is claimed is:

1. A camera tube having an envelope with a transparent portion, a target mounted within said envelope for receiving a light image transmitted through said transparent portion, and an electron beam forming and scanning means for scanning an electron beam across an exposed surface of the target, said target comprising:

a light receiving photoconductive body of a semiconductor material having opposed surfaces, one of said opposed surfaces facing the electron beam; and a layer of a solid insulator material on the surface of said body facing the electron beam, approximately 100Å to 1000Å thick, and having a surface which is the surface of the target exposed to the scanning electron beam; said insulator material having from about $10^{14}$ to $10^{19}$ carriers per cubic centimeter substantially at or further removed from the conducting band appropriate to the polarity of the carriers; the mobility of said carriers being about $10^{-6}$ to $10^{-12}$ $cm^2$ per volt second; said insulator material having a resistivity along said layer, in a direction of scan of the electron beam, of from about $10^{12}$ ohms per square to about $10^{18}$ ohms per square and said layer forming a blocking contact along an interfacing region with said body whereby a charge may be accumulated along a portion of said layer abutting said semiconductor material and retained for a period of time exceeding 1/10 of a second substantially as a charge replica of a light image impinging upon said target.

2. A camera tube in accordance with claim 1 including a transparent electrically conductive film, facing the transparent portion of the envelope, on the other opposed surface of the semiconductor body.

3. A camera tube in accordance with claim 2 in which the solid insulator material layer comprises a conductive glass.

4. A camera tube in accordance with claim 2 in which the solid insulator material layer comprises an ionically conductive glass.

5. A camera tube in accordance with claim 2 in which the solid insulator material layer comprises an insulator material including particles of an electrically conductive material disposed throughout.

6. A camera tube in accordance with claim 8 in which the solid insulator material layer is composed of a cermet material.

7. In a camera tube having an envelope with a transparent portion, a target mounted within said envelope for receiving a light image transmitted through said transparent portion, and an electron beam forming and scanning means for scanning an electron beam across a surface of the target, said surface being exposed to the electron beam, said target comprising:

a light receiving photoconductive body of a semiconductor material having opposed surfaces, one of said opposed surfaces facing the electron beam; and a layer of solid insulator material on the surface of said body facing the electron beam, approximately 100A to 1000A thick, and having a surface which is the surface of the target exposed to the scanning electron beam; said insulator material having from about $10^{14}$ to $10^{19}$ conductive particles per cubic centimeter, said layer forming along an interfacing region with said body, a blocking contact.

8. A camera tube in accordance with claim 7, including a transparent electrically conductive film, facing the transparent portion of the envelope, on the other opposed surface of the semiconductor body.

9. A camera tube in accordance with claim 8, in which said layer comprises an insulator material including metal particles disposed throughout.

* * * * *

UNITED STATES PATENT AND TRADEMARK OFFICE
CERTIFICATE OF CORRECTION

PATENT NO. : 4,139,796

DATED : February 13, 1979

INVENTOR(S) : Albert Rose

It is certified that error appears in the above-identified patent and that said Letters Patent is hereby corrected as shown below:

Claim 6, Column 6, Line 63 "claim 8" should be --claim 2--.

Signed and Sealed this

*First* Day of *May 1979*

[SEAL]

*Attest:*

RUTH C. MASON
*Attesting Officer*

DONALD W. BANNER
*Commissioner of Patents and Trademarks*